United States Patent [19]

Raty

[11] 4,283,894

[45] Aug. 18, 1981

[54] DECORATIVE ARCH FORM

[76] Inventor: Gary L. Raty, 2323 Belknap Ave., Billings, Mont. 59101

[21] Appl. No.: 137,905

[22] Filed: Apr. 7, 1980

Related U.S. Application Data

[63] Continuation of Ser. No. 899,749, Mar. 24, 1978, abandoned.

[51] Int. Cl.[3] ..... B44F 7/00

[52] U.S. Cl. ..... 52/311; 52/288; 52/DIG. 8

[58] Field of Search ..... 52/311, DIG. 8, 288, 52/211, 85, 712, 715; D25/79, 70; 248/248, 250, 300, 205 R; 403/231, 232.1

[56] References Cited

U.S. PATENT DOCUMENTS

| | | | |
|---|---|---|---|
| 101,572 | 5/1870 | Blackburn et al. | 52/288 |
| 820,641 | 5/1906 | Gleason | 52/288 X |
| 1,782,147 | 11/1930 | Merryweather | 52/85 |
| 2,005,572 | 6/1935 | Vass | 52/85 |
| 2,442,929 | 6/1948 | Marino | 52/85 |
| 3,194,527 | 7/1965 | Gruss | 248/300 X |
| 3,277,624 | 10/1966 | Cornell | 52/DIG. 8 X |
| 3,300,940 | 1/1967 | Golasz | 52/DIG. 8 X |
| 3,421,269 | 1/1969 | Medow | 52/311 X |
| 3,466,071 | 9/1969 | Reed | 248/248 X |
| 3,842,557 | 10/1974 | Brown | 52/311 X |
| 3,902,294 | 9/1975 | Brown | 52/311 X |

FOREIGN PATENT DOCUMENTS

| | | | |
|---|---|---|---|
| 428473 | 5/1935 | United Kingdom | 248/248 |
| 831650 | 3/1960 | United Kingdom | 248/300 |

*Primary Examiner*—Carl D. Friedman
*Attorney, Agent, or Firm*—Arthur L. Urban

[57] ABSTRACT

A decorative arch form including a pair of side sections, each of the side sections having two edges substantially perpendicular to one another, integral flange members extending from the perpendicular edges of each of the side sections with lines of reduced thickness at the junctures of the flange members with the sections, the side sections being disposed in a substantially parallel spaced relationship with the flange members of one side section in alignment with the flange members of the other side section, a decorative facia section connecting corresponding edges of the aligned side sections and extending from the far ends of the aligned flange members of the parallel side sections to the far ends of the flange members which are perpendicular thereto.

5 Claims, 5 Drawing Figures

DECORATIVE ARCH FORM

This is a continuation of U.S. application Ser. No. 889,749 filed Mar. 24, 1978, now abandoned.

This invention relates to a novel arch form and more particularly relates to a new decorative arch form of unique design.

Arches have been utilized throughout history both as structural units and for decorative purposes. Arches have been made of a variety of structural materials including stone, brick, wood, steel, precast concrete and the like. All of these structural materials are quite heavy in weight which necessitates that the arch supporting framework have a high load-bearing capacity. Thus, the design and construction of arches ordinarily is relatively expensive.

In recent years, arches have gained renewed popularity as decorative features for home interiors and exteriors. Many of these arches are exclusively for decorative purposes and do not serve any structural function. However, even such decorative arches are costly and difficult to install. Generally, the arch components are prefabricated of wood and then mounted in their desired position. Since even decorative wooden arches are quite heavy, it is essential that they be fastened securely to the supporting structure to maintain them in place and avoid the possibility of them falling to the floor and injuring persons or furnishings located under the arch.

After the arch has been mounted properly, the wall and ceiling surfaces adjacent to the arch must be finished to cover any gaps or unevenness between the arch and the wall and/or ceiling surfaces. This may involve plastering or alternatively, the application of sheet rock, paneling, moldings or the like to cover the area surrounding the arch. In any case, the individual doing the work must exercise a high degree of care to ensure that the finished job will be neat and aesthetically pleasing. To achieve this result requires special attention and extra time and effort. Thus, arches formed with wooden components have the drawbacks of high cost, heavy weight and complicated installation and finishing procedures.

It has been proposed to substitute foamed plastic components for wooden ones in certain decorative applications such as exposed beams. These foamed plastic products are less expensive to fabricate than wooden components. Also, they are much lighter in weight which makes it simpler to attach them to their supporting structure. However, once they are fastened in place, the same high degree of care that is required for wooden components must be exercised in the finishing of the adjacent wall and ceiling surfaces.

The present invention provides a novel decorative arch form which is simple to install, light in weight and relatively inexpensive to manufacture. The unique design of the arch form of the invention simplifies installation and subsequent finishing of adjacent wall and ceiling surfaces. Also, the arch form can be installed quickly and conveniently without special tools or skills and with only a minimum of instruction. In addition, the arch form of the invention is light in weight so that it can be installed by simply tacking, stapling, gluing, etc, to the supporting structure. Further, the arch form has a surface which resists scratching, denting or other damage that may occur during installation and/or subsequent use. Also, the arch form can be fabricated from commercially available materials relatively inexpensively.

Other benefits and advantages of the novel arch form of the present invention will be apparent from the following description and the accompanying drawings in which.

Figure 1:
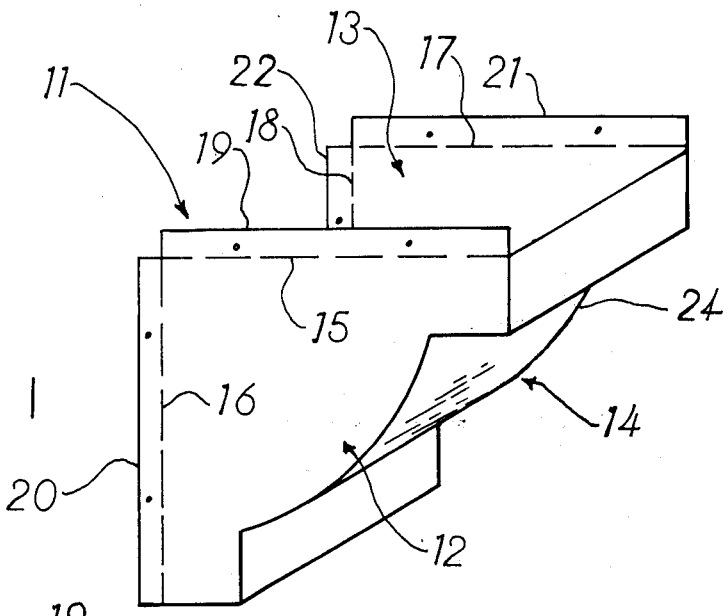
FIG. 1 is a view in perspective of one of the novel arch forms of the invention.
Figure 2:
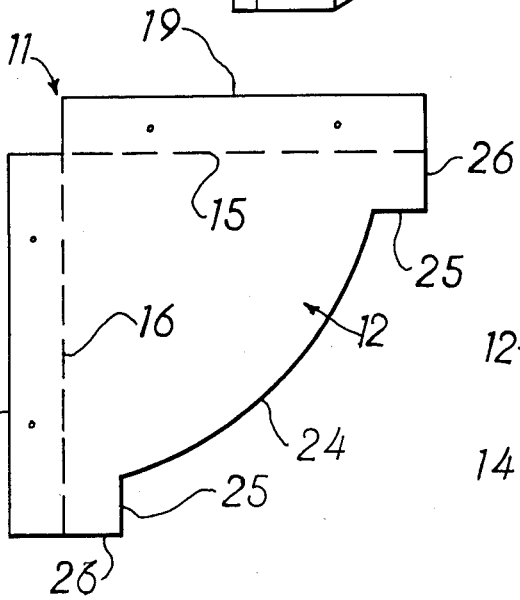
FIG. 2 is an end view of the arch form shown in FIG. 1.
Figure 3:
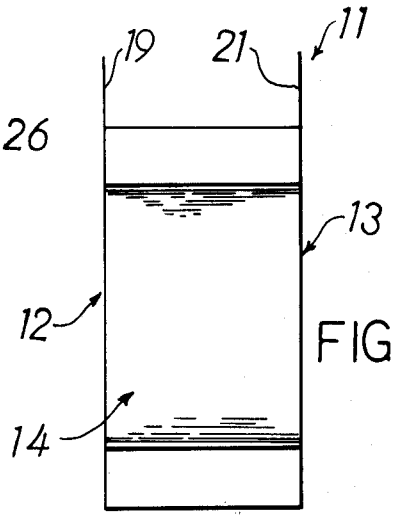
FIG. 3 is a side view of the arch form shown in FIG. 1.

As shown in FIGS. 1–4 of the drawings, one arch form 11 of the invention includes a pair of side sections 12 and 13 disposed in a substantially parallel spaced relationship. A decorative facia section 14 connects the corresponding edges of the side sections.

Each of the side sections 12 and 13 has two edges 15 and 16 and 17 and 18, respectively, which are substantially perpendicular to one another. Flange members 19 and 20 are integral with side section 12 and extend from respective edges 15 and 16 thereof. Likewise, side section 13 has flange members 21 and 22 which extend from respective edges 17 and 18. Lines of reduced thickness are located at the junctures of the flange members 19 and 20 and 21 and 22 with the perpendicular edges 15 and 16 and 17 and 18 of the side sections 12 and 13.

The flange members 19 and 20 of side section 12 are disposed in alignment with the corresponding flange members 21 and 22 of side section 13 when the two side sections are positioned in a substantially parallel spaced relationship. Advantageously, the flange members 19–22 extend along the full length of the edges 15–18 to facilitate mounting of the arch form.

Decorative facia section 14 connects the corresponding edges of aligned side sections 12 and 13. Facia section 14 extends from the far ends of flange members 19 and 21 of the respective side sections 12 and 13 to the far ends of the opposite flange members 20 and 22 of the same side sections. This configuration provides a continuous enclosure for the arch form when it is in place. Facia section 14 may be of any desired shape or configuration. FIGS. 1–4 illustrate a configuration with a convex portion 24 with end portions which have relatively flat sections 25 and 26 that are perpendicular to the side sections 12 and 13. Flat sections 25 and 26 also are perpendicular to each other at the ends of facia section 14 to provide a continuous surface from the horizontal supporting structure to the vertical portion of the supporting structure, e.g. from the ceiling to the wall.

Figure 5:
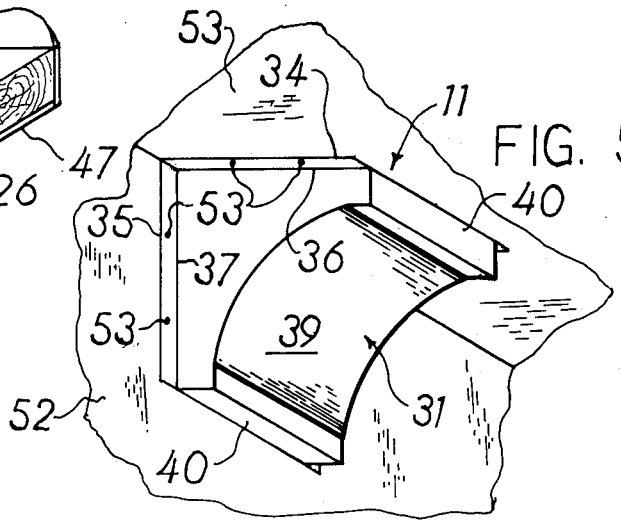
FIG. 5 is a view in perspective from below of another of the arch forms of the invention mounted at the juncture of a wall and ceiling.

FIG. 5 illustrates another configuration of the novel arch form of the invention in which facia section 31 connects side sections (only one section 32 of which is shown). Side section 32 has flange members 34 and 35 extending from the perpendicular edges 36 and 37 thereof. Facia section 31 has a concave portion 39 which extends between end portions 40. End portions 40 are flat sections which are perpendicular to the side sections.

Figure 4:
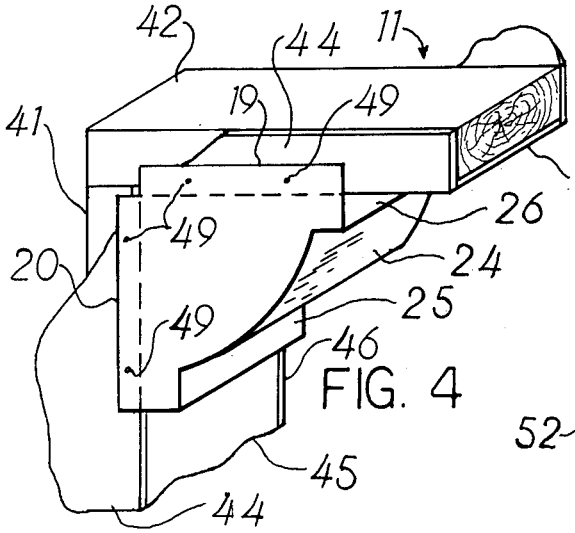
FIG. 4 is a view in perspective showing the arch form of FIG. 1 mounted within a doorway frame.

In the utilization of the novel arch form of the present invention as shown in FIG. 4, the arch form 11 is fastened in a doorway frame formed with stud 41 and header 42. Sheet rock panels 44–47 are fitted around the stud and header and the other portions of the structural framework (not shown). The arch form 11 is slid into place with flange members 19 and 20 in contact with sheet rock panel 44 and flange members 21 and 22 in contact with sheet rock panel 46 on the opposite side of the doorway frame. With the arch form in proper position, flat sections 25 and 26 of facia section 14 will abut sheet rock panels 45 and 47. When the arch form is properly positioned within the doorway frame, the form is secured thereto by nailing the flange members 19–22 to the sheet rock panels at points 49.

An alternative method of installation of the novel arch form of the invention is shown in FIG. 5. The flange members 34 and 35 of side section 32 are folded so that they are at right angles to the side section. The arch form then is placed into contact with the ceiling 51 and the wall 52 at the juncture thereof. In this position, the edges of the side sections which are adjacent to the flange members are in abutment with the ceiling and wall. Likewise, the flange members are disposed substantially parallel to the ceiling and wall surfaces and in contact therewith. The flange members (both those on side section 32 and those not shown) are secured to the adjacent ceiling and wall surfaces, e.g. by nailing at points 53.

Since the flange members of the arch forms shown both in FIGS. 4 and 5 form a smooth surface with the adjacent sheet rock panels without any gaps or cracks, very little finishing is required. If the flange members are relatively thin, it may not be necessary to do any finishing besides painting. On the other hand, if the flange members are of somewhat greater thickness, it may be desirable to taper the edges of the flange members where they contact the adjacent surfaces with a filler. If desired, the flange members themselves may be tapered toward their outer edges during the fabrication of the arch form. In any case, the flange members provide a smooth fit with the adjacent surfaces without gaps or unevenness and the flange members provide a convenient means for securing the arch form to the supporting structure.

The arch form of the present invention may be fabricated from a variety of materials. Advantageously, it may be molded or pressed from a sheet material or a particulate material. For example, the arch form may be molded from fibrous or plastic sheets or from fibrous or plastic particles. Preferably, the arch form may be molded as a single unit and in a single operation, such as by injection molding.

The above description and the accompanying drawings show that the present invention provides a novel decorative arch form which is simple to install without special tools or training and with only a minimum of instruction. Also, the novel arch form of the invention is light in weight so that it can be installed with a minimum of effort by simple and conventional fastening techniques such as tacking, stapling, gluing and the like. Furthermore, the unique design of the arch form not only simplifies installation, but also simplifies and minimizes the amount of finishing required on adjacent wall and ceiling surfaces after the arch form is installed. Moreover, the arch form of the invention has a surface which resists denting, scratching and other damage occurring during installation and/or subsequent use. In addition, the arch form can be fabricated relatively inexpensively from commerciallly available materials.

It will be apparent that various modifications can be made in the particular arch forms described in detail above and shown in the drawings within the scope of the invention. For example, the size and shape of the various components of the arch form may be different for specific requirements. Also, the configuration of the facia surface may be changed to provide desired aesthetic effects and appearances. Therefore, the scope of the invention is to be limited only by the following claims.

What is claimed is:

1. A decorative arch form molded from a plastic material as an integral unit, said arch form including a pair of side sections, each of said side sections having two edges substantially perpendicular to one another, integral flange members extending along substantially the full length of said perpendicular edges of each of said side sections with lines of reduced thickness at the junctures of the flange members with said sections, said flange members having tapered edges, a plurality of openings arranged along the length of said flange members intermediate the width thereof, said side sections being disposed in a substantially parallel spaced relationship with said flange members of one of said side sections in alignment with said flange members of the other of said side sections, a decorative facia section connecting corresponding edges of said aligned side sections and extending from the far ends of said aligned flange members of said parallel side sections to the far ends of said flange members which are perpendicular thereto, whereby said arch form can be attached to connecting ceiling and wall panels with major surfaces of said flange members bearing against surfaces of said panels.

2. A decorative arch form according to claim 1 wherein said decorative facia section includes a convex portion.

3. A decorative arch form according to claim 1 wherein said decorative facia section includes a concave portion.

4. A decorative arch form according to claim 1 wherein said decorative facia section includes end portions which are substantially perpendicular to said side sections.

5. A decorative arch form according to claim 1 wherein said flange members are disposed at right angles to said side sections.

* * * * *